United States Patent [19]

Füssner

[11] 4,233,584

[45] Nov. 11, 1980

[54] FLUID-SEALED, ELECTROMAGNETIC VALVE OPERATING STRUCTURE, PARTICULARLY FOR COMBUSTION ENGINE FUEL INJECTION SYSTEM

[75] Inventor: Paul Füssner, Sindelfingen, Fed. Rep. of Germany

[73] Assignee: Robert Bosch GmbH, Stuttgart, Fed. Rep. of Germany

[21] Appl. No.: 12,116

[22] Filed: Feb. 14, 1979

[30] Foreign Application Priority Data

Mar. 24, 1978 [DE] Fed. Rep. of Germany ... 7809106[U]

[51] Int. Cl.[3] ..... H01H 7/08

[52] U.S. Cl. ..... 335/260; 335/278

[58] Field of Search ..... 335/260, 52, 151, 202, 335/278, 244

[56] References Cited

U.S. PATENT DOCUMENTS

| | | | |
|---|---|---|---|
| 3,598,360 | 8/1971 | Merriner | 335/260 |
| 4,067,541 | 1/1978 | Hunter | 335/260 |
| 4,073,277 | 2/1978 | Eheim | 123/139 |
| 4,088,975 | 5/1978 | Lang | 335/244 |

*Primary Examiner*—Harold Broome

*Attorney, Agent, or Firm*—Frishauf, Holtz, Goodman & Woodward

[57] ABSTRACT

To provide for effective sealing of the solenoid coil structure with respect to fluid, the flow of which is to be controlled, a sleeve with a closed bottom, preferably integral with the sleeve, is inserted in the coil, and is in gap-free engagement with a core portion extending into the opening of the solenoid coil, a plunger-type armature being movable within the sleeve. The outer portion of the sleeve is sealed to the housing, for example by a solder connection, so that the interior of the solenoid is separated in liquid-tight relationship from the interior of the sleeve to prevent contamination of the space containing the winding by fluid being controlled by the valve. The housing, at the outside, may be formed with a groove in which a sealing ring is located to seal the housing to a pump assembly with which the valve is to be used.

7 Claims, 2 Drawing Figures

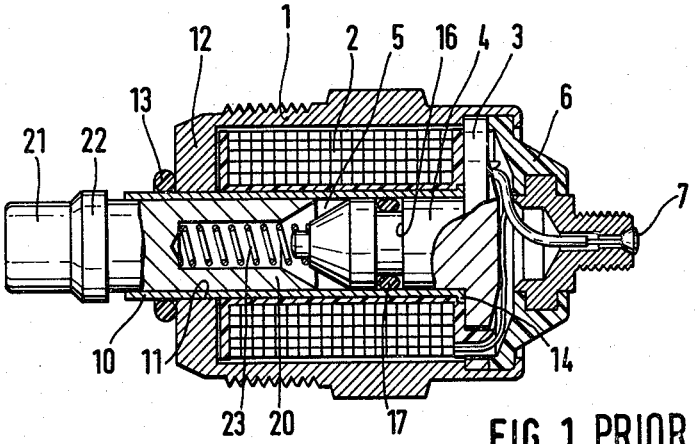
FIG. 1, PRIOR ART
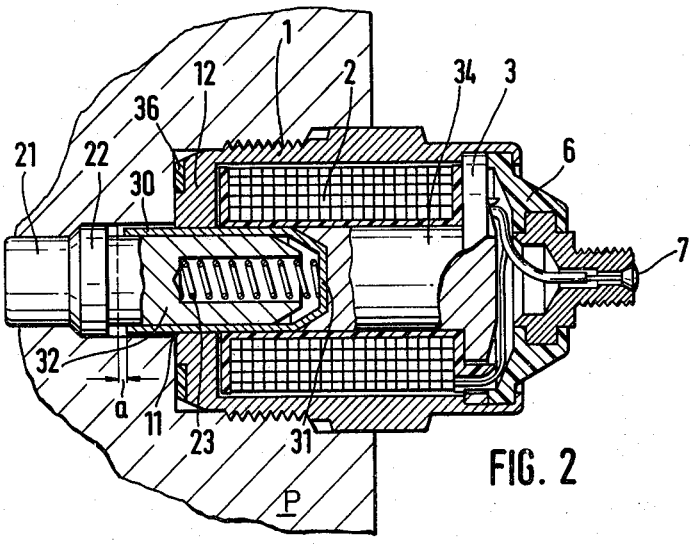
FIG. 2

FLUID-SEALED, ELECTROMAGNETIC VALVE OPERATING STRUCTURE, PARTICULARLY FOR COMBUSTION ENGINE FUEL INJECTION SYSTEM

The present invention relates to an electromagnetically operated positioning device, and more particularly to a fluid-sealed positioning structure for electromagnetically operated valves, especially for use with fuel injection systems of internal combustion engines.

BACKGROUND AND PRIOR ART

Various fuel injection control valves have been proposed; in one such known arrangement, a sleeve is frictionally retained in a passage guideway through which a magnetic core is guided. The magnetic coil is sealed from fluid by two O-rings, one of which is seated on the sleeve at the outside thereof adjacent the passage through the housing of the valve, and the other one is seated in a ring groove of the magnetic core. The outer O-ring is securely pressed against the housing of the valve and against the sleeve when the sleeve and valve are connected together. The other O-ring, that is the O-ring sealing the core, is seated at the inside of the sleeve, with biased compression. This arrangement is comparatively complex and does not ensure sealing of fluid with respect to the electrical portion of the valve, or its electric operating control, particularly over long operating periods. In due course, the seal may not be tight anymore.

THE INVENTION

It is an object to provide a sealed electromagnetically operated positioning structure, and more particularly a sealed valve suitable for use with a fuel injection system for an internal combustion engine in which the magnetic operating coil or solenoid is reliably sealed with respect to the fluid and in which the structure is so arranged that a test for fluid tightness, after installation, can be omitted.

Briefly, the sealing sleeve within which the core operates and the outer housing for the solenoid coil are bonded together in sealed relation, for example by being soldered together. The sealing sleeve is internally closed and positioned in close, immediately adjacent engagement with the inner surface of a portion of the core of the armature which is constructed to extend within the opening of the solenoid coil, that is, the opening within which the movable magnetic core operates. Thus, one side of the sleeve can be exposed to the fluid to be controlled, the other side of the sleeve—due to its closed end—completely separating the coil structure, and associated structures from the fluid.

The end or bottom of the sleeve can be accurately dimensioned so as to maintain the desired and designed air gap between the movable armature and the portion of the core of the solenoid extending into the opening thereof so that the armature will be accurately positioned with respect to the core and sticking of the armature on the magnetic core is reliably prevented. The facing surfaces of the core and the armature can easily machined accurately and to close tolerances, so that the tolerances with respect to positioning force are reduced to a minimum. The armature can be unitary with a positioning element which is formed to have a flange which, upon energization of the solenoid, faces against an outer edge of the sleeve. The position of the armature within the solenoid coil—upon its energization—then will depend only on the length of the sleeve and the distance of the flange or shoulder from the end face of the armature. These distances can be maintained easily to very close tolerances without excessive costs; abrupt engagement or impingement of the flange or shoulder on the endge of the sleeve can be prevented by slightly spacing the flange or abutment from the edge of the sleeve. Possible jamming of the armature due to deformation of the sleeve is thus reliably prevented.

Drawings, illustrating a preferred example:

FIG. 1 is a longitudinal cross-sectional view—highly schematic and omitting elements not necessary for an understanding of the invention—of a positioning element for a valve, in accordance with the prior art; and FIG. 2 is a structure incorporating the present invention and usable as a replacement for the structure of FIG. 1.

The valve of FIG. 1 is of a customary type. It is useful for combination with a distribution pump a of fuel injection system for a Diesel engine. It has a generally cup-shaped housing 1 in which a solenoid coil 2 is located. The housing 1 surrounds the solenoid coil from one facing end thereof. The second facing end of the solenoid coil is engaged by a plate 3 which carries a magnetic core 4, extending for some distance into the opening 5 of the solenoid 2. The open side of the housing 1 is closed off by a cover plate 6 made of plastic material. One electrical connection for the solenoid 2 is carried out through the cover plate 6; the oher electrical terminal may be secured to the housing 1 which, customarily, is of metal.

The opening 5 of the magnetic coil is generally cylindrical. It is lined by a sleeve 10 made of non-magnetic material, for example brass or bronze. The magnetic core 4 surrounds the sleeve 10. Sleeve 10 passes through an opening 11 in the bottom 12 of the housing 1, which also forms part of the magnetic circuit. A sealing ring 13 is located against the bottom wall 12 of the housing. The sleeve 10 has a peened or roled-over edge 14 which secures the sleeve between the coil 2 and the plate 3 in fixed axial position. This is the only connection necessary to hold the sleeve in place, and no further fixed connection with the housing 1 and the coil 2 is usually provided. The core 1 is formed with a groove 16 to receive a sealing ring 17, in form of an O-ring which is compressed and engages the inside of the housing 10 with bias-force engagement.

An armature 20 is located in the sleeve 10. The armature 20 is unitary with a positioning element 21, forming part of the fuel injection pump or valve. The positioning element 21 has a circular surrounding flange 22. An internal spring 23 has the tendency to push the armature 20 away from the core 4 into a rest or quiescent position. The left-end position of the armature 20 and of the positioning element 21 is determined by components of the distribution pump—not shown—and limits the excursion of armature 20 and positioning element 21 towards the left, as shown in FIG. 1.

In assembly, sealing ring 13 is compressed axially to tightly engage sleeve 10 and the facing end of the botom 12. The sealing ring 17 ensures that any fuel which penetrates into the gap between the armature 20 and the sleeve 10 will not further penetrate to the other facing side of the coil 2 and its electrical connections.

FIG. 2 illustrates the structure in accordance with the present invention. Similar parts and operating similarly have been given the same reference numerals.

In contrast to the open sleeve 10, a closed sleeve 30 is used having a closed bottom or end 31 which is in engagement with the end 34 of the core which faces the armature 32. The bottom or end wall 31 is close to the face of the core 34, engaging this face essentially, and preferably, without a gap. The closed sleeve 30 is soldered to the bottom 12 of the housing at the point where it passes through the opening 11. Other bonding or connecting arrangements may be used. The soldered or other similar joint is liquid-tight. The sealing rings 13, 17 used in the embodiment of FIG. 1 are omitted. The bottom 12 of the housing 1 is formed with a groove facing a shoulder in the pump housing, generally shown as P, and having a sealing ring 36 therein. When the assembly is secured in the pump housing, the sealing ring 36 provides for a tight seal of the electromagnetic positioning device with respect to the pump housing, and seals the inside of the pump housing with respect to the outside thereof.

The inner closing wall 31 of the sleeve 30 guarantees exact maintenance of the predetermined air gap between the armature 32 and the core portion 34 which is positioned within the central opening of the solenoid winding 2. In operation, and when the solenoid winding 2 is energized, and the armature moves towards the right—with respect to FIG. 2—the shoulder 22 on the positioning element 21 will move towards the right to the position shown in broken lines. A small distance a is left between the shoulder 22 and the end of the sleeve 30. This distance can be easily and accurately maintained since it depends only on the longitudinal tolerance of the sleeve 30 and the tolerance of the positioning of the flange or projection 22 from the end face of the armature 32. This dimension can be easily maintained with high accuracy during manufacture. Thus, engagement of the projection or flange 22 with the end edge of the sleeve 30 is reliably prevented. Upon energization of the solenoid coil 2, the engagement can be rapid and repeated engagement may cause deformation or damage to the end of the sleeve 30, causing possible problems in extended operation due to jamming or pinching of the sleeve 30, as deformed, around the armature core element 32. The engagement of the armature 32 against the inner end wall 31 can extend over a substantial surface so that the impingement force per unit area can be held substantially below the impingement force of a ring shoulder against the edge of the sleeve. Although the sealing rings 13, 17 sealing fluid with respect to sleeve 10 (FIG. 1) have been omitted, the coil is reliably sealed against contamination from fluid which penetrates the space between the armature 32 and the sleeve 30 (FIG. 2) so that test of fluid tightness of the armature assembly, and specifically the solenoid portion of the housing and the interior thereof with respect to fluid being controlled by the unit, after connection to the distribution pump, can be omitted.

Various changes and modifications may be made within the scope of the inventive concept.

The structure in accordance with the present invention is particularly suitable to control Diesel oil with pressure of maximum 15 bar.

I claim:

1. Fluid-sealed, electromagnetic positioning device, particularly for use as an electromagnetic valve operator suitable in a fuel injection system of an internal combustion engine having a housing (1);

a solenoid coil (2) positioned in the housing and formed with a central, tubular opening;

a magnetic core element (34) having a portion extending across said opening;

a magnetic armature (32) longitudinally movable in said opening;

a sealing sleeve (30) extending into the tubular opening to seal the interior of the solenoid against fluid, the flow of which is to be controlled, and to guide the longitudinal movement of the armature, a closed bottom (31) formed on the sealing sleeve and positioned in close engagement with the inner face of the portion of the core (34) extending across said opening;

and an abutment (22) formed on the armature (32), said abutment being positioned beyond the end of the sleeve (30), the length of the sleeve and the position of the abutment being matched with respect to the length of travel of the armature (32) upon energization of the solenoid coil (2) to provide for a gap between the abutment (22) and the end of the sleeve (30) and maintenance of a gap between the end of the armature and the portion (34) of the core extending across the opening which is determined by the thickness of the closed bottom (31) of the sleeve to prevent sticking of the armature to the core and damage to the end of the sleeve (30) facing said abutment (22).

2. Device according to claim 1, wherein the housing has an opening therethrough in alignment with the opening of the solenoid coil, said sealing sleeve passing through said opening, and the outer circumference of the sealing sleeve and the housing being bonded together where the sealing sleeve passes through the opening in the housing.

3. Device according to claim 2, wherein the bonding connection between the sealing sleeve and the housing comprises a solder connection.

4. Device according to claim 1, wherein the closed bottom (31) forms an end wall of the sealing sleeve integral with the sealing sleeve.

5. Device according to claim 3, wherein the closed bottom (31) forms an end wall of the sealing sleeve integral with the sealing sleeve.

6. Device according to claim 4, wherein the core portion (34) extends into the opening within the solenoid;

and the closed bottom (31) of the sealing sleeve is in essentially gap-free engagement with said inwardly extending core portion.

7. Device according to claim 1, wherein the closed bottom (31) forms an end wall of the sealing sleeve integral with the sealing sleeve;

the core portion (34) extends into the opening within the solenoid;

and the closed bottom (31) of the sealing sleeve is in essentially gap-free engagement with said inwardly extending core portion.

* * * * *